United States Patent [19]

Ogawa

[11] Patent Number: 4,687,722

[45] Date of Patent: Aug. 18, 1987

[54] IMAGE HOLDER MEMBER WITH OVERLAYER OF AMORPHOUS SI WITH H AND C

[75] Inventor: Kyosuke Ogawa, Sakurashin, Japan

[73] Assignee: Canon Kabushiki Kaisha, Tokyo, Japan

[21] Appl. No.: 946,092

[22] Filed: Dec. 23, 1986

Related U.S. Application Data

[63] Continuation of Ser. No. 634,436, Jul. 26, 1984, abandoned.

[30] Foreign Application Priority Data

Aug. 3, 1983 [JP] Japan ..... 58-142208

[51] Int. Cl.[4] ..... G03G 5/14

[52] U.S. Cl. ..... 430/59; 430/58; 430/57; 430/66; 430/67

[58] Field of Search ..... 430/57, 58, 66, 67, 430/59

[56] References Cited

U.S. PATENT DOCUMENTS

| | | | |
|---|---|---|---|
| 4,349,617 | 9/1982 | Kawashiri et al. | 430/58 X |
| 4,356,246 | 10/1982 | Tabei et al. | 430/96 X |
| 4,361,638 | 11/1982 | Higashi et al. | 430/58 |
| 4,394,425 | 7/1983 | Shimizu et al. | 430/67 X |
| 4,430,404 | 2/1984 | Hosoya et al. | 430/58 |
| 4,452,875 | 6/1984 | Ogawa et al. | 430/57 |

FOREIGN PATENT DOCUMENTS

| | | | |
|---|---|---|---|
| 94224 | 11/1983 | European Pat. Off. | 430/58 |
| 57-115556 | 7/1982 | Japan | 430/67 |
| 57-115559 | 7/1982 | Japan | 430/67 |
| 58-88753 | 5/1983 | Japan | 430/67 |

*Primary Examiner*—Roland E. Martin

*Attorney, Agent, or Firm*—Fitzpatrick, Cella, Harper & Scinto

[57] ABSTRACT

An image holding member which contains a photosensitive layer of photoconductive material and an amorphous film overlayer containing at least silicon atoms, hydrogen atoms and carbon atoms as main components, wherein the amorphous film is formed by discharge in a gaseous atmosphere of organohydrogenosilane is disclosed.

30 Claims, 1 Drawing Figure

IMAGE HOLDER MEMBER WITH OVERLAYER OF AMORPHOUS SI WITH H AND C

This application is a continuation of application Ser. No. 634,436 filed July 26, 1984, now abandoned.

BACKGROUND OF THE INVENTION

1. Field of the Invention

This invention relates to an image holding member for electrophotography sensitive to electromagnetic waves such as light (here referred to a light in a broad sense including ultraviolet ray, visible light, infrared ray, X-ray, γ-ray and the like).

2. Description of the Prior Art

Heretofore, as photoconductive materials constructing image holding members for electrophotography, there have been known generally inorganic photoconductive materials such as Se, Cds, ZnO and the like and organic photoconductive materials (hereinafter referred to as "OPC") such as PVK (polyvinylcarbazole), TNF (tetranitrofluorenone) and the like. However, at present the known photoconductive materials can not simultaneously satisfy the characteristics required for image holding members for electrophotography such as high sensitivity, good S/N ratio (photo-current/dark current), wide range absorption spectrum, high light response, high dark resistance, stability upon repeated use and the like.

There have been recently proposed various practical OPC type image holding members since they are of low cost and do not cause any environmental pollution, and as a result of improvement, they have now excellent electrophotographic fundamental characteristics such as latent image formation, photosensitivity and the like which there is much room for improvement as to stability upon repeated use such as resistance to mechanical, optical or electrical external action. In particular, with respect to mechanical action, the surface of the OPC type image holding member is easily scratched even with a slight action force such as, for example, the action force of a blade used for cleaning the remaining toner (such cleaning is essential to electrophotographic processes) since the surface of the image holding member is made of an organic material. While the member is repeatedly used, the toner attaches to the scratched portions and therefore, the copied images become unclear gradually. Thus, the image holding member can be used only a limited number of times.

In order to supplement the mechanical strength of the OPC image holding member, there is proposed to form a surface protective layer of various kinds, for example, laminating with an organic material layer having a higher hardness by coating, depositing an inorganic layer by means of vacuum vapor deposition, laminating with a material capable of being surface-hardened by applying a thermal hysteresis, and the like.

However, these methods can give a sufficient function of a protective layer, but there are caused side effects undesirable for fundamental characteristics of electrophotography such as lowering of resolution, lowering of image quality, change of characteristics during using for a long time and the like, and when it is tried to make the characteristics compatible, all the characteristics often become insufficient resulting in impractical image holding members.

As mentioned above, any satisfactory results are not obtained. This results from the fact that there are very few materials which are excellent in mechanical strength and satisfy the function of the most surface layer of electrophotographic image holding members with respect to electric and optical characteristics. Even if there are obtained the above-mentioned desirable materials, there is not easily available a means suitable for laminating the material to form freely a thin and uniform layer without damaging the photoconductive layer. This is one of the reasons retarding solving the above problems.

Among the various methods proposed heretofore, the most popular method is a coating method in which a constant viscosity of a coating slurry is required so as to coat uniformly, but when a high viscosity is employed, the resulting coated layer is apt to be thick. Most of the materials having high hardness are non-photoconductive so that they retard photoconductive action and the image quality is lowered when the protective layer is unnecessarily thick.

Alternatively, for example, when an inorganic thin film such as $SiO_2$ and the like is produced by means of a vacuum vapor deposition, the substrate temperature should be elevated to some extent to produce a good quality film, but OPC layers are usually weak to heat and are subjected to thermal damage upon forming a protective layer. In addition, vacuum vapor deposition, sputtering and the like have a directivity with respect to film forming atoms incident upon the substrate surface so that uniform and large area can be disadvantageously obtained with difficulty.

SUMMARY OF THE INVENTION

An object of the present invention is to provide an image holding member of excellent repeating durability and electrophotographic characteristics, in particular, an OPC series image holding member having such excellent properties.

Another object of the present invention is to provide an image holding member having excellent rubbing resistance upon a contacting step (for example, cleaning step by means of a blade, jumping developing step and the like) in electrophotographic processes.

A further object of the present invention is to provide an image holding member capable of producing good image quality of copy upon repeated electrophotographic process.

According to one aspect of the present invention there is provided an image holding member which comprises a photosensitive layer comprising a photoconductive material and a binder and an amorphous film containing at least silicon atom, hydrogen atom and carbon atom as main components overlying the photosensitive layer.

According to another aspect of the present invention, there is provided an image holding member which comprises a photosensitive layer of a laminate structure comprising a charge generation layer and a charge transport layer and an amorphous film containing at least silicon atom, hydrogen atom and carbon atom as main components overlying the photosensitive layer.

According to a further aspect of the present invention, there is provided an image holding member which comprises a photosensitive layer comprising a photoconductive material and a charge transport binder and an amorphous film containing at least silicon atom, hydrogen atom and carbon atom as main components overlying the photosensitive layer.

DESCRIPTION OF THE PREFERRED EMBODIMENTS

Figure 1:
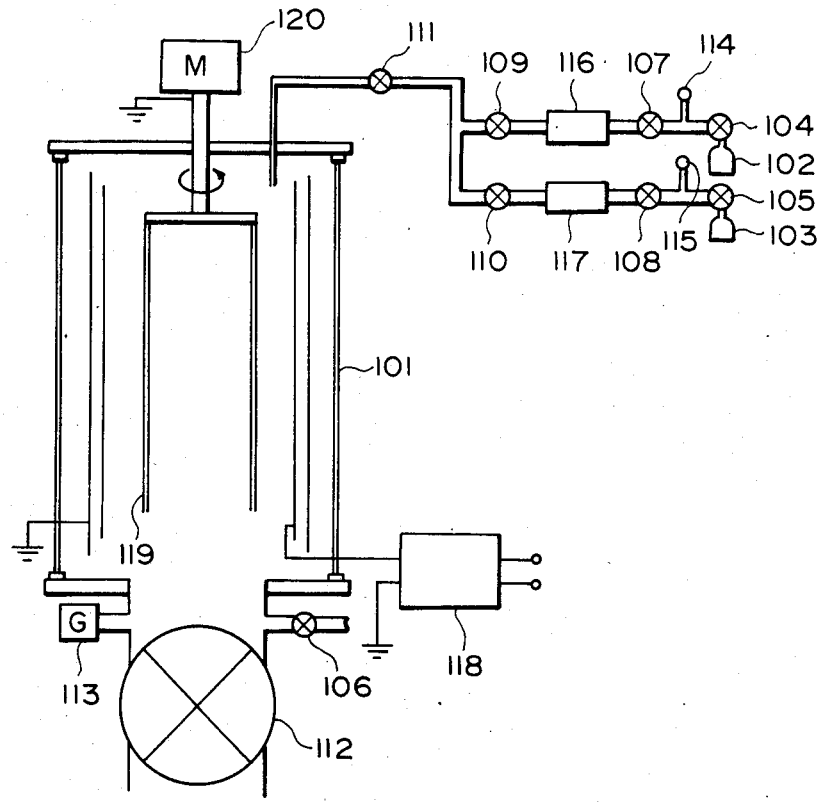
FIG. 1 shows schematically an apparatus which may be used for producing the image holding member of the present invention.

The present invention is based on a discovery that an amorphous film mainly composed of silicon atom, hydrogen atom and carbon atom (hereinafter referred to as "a-Si-C:H film") is suitable for a surface protective layer for OPC series image holding members, has an excellent mechanical strength, and, in addition, does not adversely affect the inherent electrophotographic fundamental characteristics of OPC layers.

A feature of the image holding member of the present invention resides in that the a-Si:C:H film may be formed on the OPC series image holding member without damaging the OPC layer by selecting appropriately the starting materials and optimizing the production conditions.

As the photosensitive layer used in the present invention, there may be mentioned a photosensitive layer composed of a photoconductive material dispersed in a binder, that composed of a charge generation layer and a charge transport layer in a laminate form (a function separate type), that composed of a photoconductive material dispersed in a photoconductive binder, and the like.

One of the preferable embodiments of the present invention is an image holding member where a photosensitive layer composed of a laminate structure of a charge generation layer and a charge transport layer.

Conventional charge generation layer may be used for the image holding member according to the present invention. As charge generation materials (photoconductive materials), there may be mentioned azo pigment such as sudan red, Dian Blue, Jenas Green B and the like, quinone pigment such as alcohol yellow, pyrenequinone, indanthrene brilliant violet RRP and the like, quinocyanine pigment, perylene pigment, indigo pigment such as indigo, thioindigo and the like, bisbenzimidazole pigment such as Indofast orange toner and the like, phthalocyanine pigment such as copper-phthalocyanine and the like, quinacridone pigment, the charge generation material (photoconductive material) such as co-crystalline material formed by squaric acid-methin-dye, pyrylium dye or thiapyrylium dye and polyacrylate. Such charge generation material is dispersed in a binder resin such as polyester, polystyrene, poly(vinyl chloride), poly(vinyl acetate), acrylic resin poly(vinyl pyrrolidone), poly(vinyl butyral), methyl cellulose, hydroxypropylmethyl cellulose and the like, and the product thus dispersed is coated on a charge transport layer or a substrate to form a charge generation layer. Or, as the charge generation layer, a selenium vapor deposition layer, a selenium-tellurium vapor deposition layer or an amorphous silicon film may be ued. The thicknes of the charge generation layer is, in general, 5 microns or less, preferably, 0.01–0.1 micron.

The charge transport layer is composed of a charge transport material and a binder, and produced in a form of film, and is electrically connected with a charge generatrion layer. As charge transport materials, there are hole transport materials and electron transport materials. As electron transport materials, there may be used electron acceptable materials known as anil type compound such as chloroanil, bromanil and the like, cyano type compounds such as tetracyanoethylene, tetracyanoquinodimethane and the like, nitrofluorenone type compounds such as 2,4,7-trinitro-9-fluorenone, 2,4,5,7-tetranitrofluorenone, 2,4,7-trinitro-9-dicyanomethylenefluorenone and the like, nitroxanthone type compounds such as 2,4,5,7-tetranitroxanthone, 2,4,8-trinitrothioxanthone and the like, and these electron attractive materials formed into high polymers.

As hole transport materials, there are, for example, polycyclic aromatic compounds such as anthracene, pyrene and the like, carbazoles such as N-ethylcarbazole, N-isopropylcarbazole and the like, oxadiazole compounds such as 2,5-bis(P-diethylaminophenyl)-1,3,4-oxadiazole and the like, pyrazoline compounds such as 1-phenyl-3-(P-diethylaminostyryl)-5-(p-diethylaminophenyl)pyrazoline, 1-[pyridyl(2)]-3-(p-diethylaminostyryl)-5-(p-diethylaminophenyl)pyrazoline, 1-[quinolyl-(2)]-3-(p-diethylaminostyryl)-5-(p-diethylaminophenyl)pyrazoline and the like, polyarylamines such as triphenylamine and the like, organic photoconductive polymers such as poly-N-vinylcarbazole, poly-N-vinylcarbazole halide, polyvinylpyrene, polyvinylanthracene, polyvinylacridine, poly-9-vinylphenylanthracene, pyreneformaldehyde resins, ethylcarbazoleformaldehyde resin and the like. Charge transport materials are not limited to the description as above. Charge transport materials may be used alone or in combination upon actual use. But, in case of a mixture of an electron transport material and a hole transport material, charge-transfer absorption occurs sometimes in the visible region. As a result, light does not reach the charge generation layer below the charge transport layer upon exposure. Thus this combination should be avoided. The thickness of the charge transport layer is, in general, 5–30 microns, preferably, 8–20 microns.

As the binder, there may be used acrylic resins, polystyrene, polyester, polycarbonate, cellulose derivatives and the like. As a binder for hole transport low molecular weight materials, hole transport polymers such as the above-mentioned poly-N-vinylcarbazole and the like may be used. In the meantime, as a binder for electron transport low molecular weight materials, the polymer of electron transort monomer as described in U.S. Pat. No. 4,122,113 may be used.

With respect to the layer arranging order of the charge generation layer and the charge transport layer, there is not any restriction from the viewpoint of image forming function, but it is preferable from the view points of mechanical strength and chargeability that a charge generation layer is formed on a substrate and a charge transport layer is formed on the charge generation layer.

According to one preferable embodiment of the present invention, a photosensitive layer may be produced by dispersing a photoconductive material capable of generating electric charge when receiving an electromagnetic wave (for example, the above-mentioned charge generation materials) in a charge transport matrix (in particular, organic photoconductive polymers capable of charge transport such as polyvinylcarbazole, polyvinylanthracene and the like).

In this case, the total layer thickness of the OPC layer is usually 5–30 microns, preferably 8–20 microns. The structure of the OPC layer may be other than the above-mentioned fundamental structure. If desired, another layer may be added to the fundamental structure so as to impart other functions. As a representative example, in order to improve adhesivity, there is usually provided an adhesive layer composed of casein, polyvinyl alcohol, water-soluble polyethylene, nitrocellulose or the like between the conductive substrate and the OPC layer.

Either conductive or insulating material may be for the substrate which holds the photosensitive layer of the image holding member according to the present invention. As the substrate that itself is conductive, there may be mentioned a metal such as NiCr, stainless steel, Al, Cr, Mo, Au, Nb, Ta, V, Ti, Pt, Pd and the like or their alloys.

As the electrically insulating substrate, there may be usually used a film or sheet of a synthetic resin such as polyester, polyethylene, polycarbonate, cellulose acetate, polypropylene, poly(vinyl chloride), poly(vinylidene chloride), polystyrene, polyamide and the like, glass, ceramic, paper and the like. These electrically insulating substrates are preferably electroconductivized at least at one surface and provide other layer is disposed on said electroconductivized surface.

That is, for example, in the case of glass, conductivity is imparted by coating the surface with a thin film of NiCr, Al, Cr, Mo, Au, Ir, Nd, Ta, V, Ti, Pt, $In_2O_3$; $SnO_2$ ITO ($In_2O_3+SnO_2$) or the like, or conductivity is imparted to the surface of a synthetic resin film such as a polyester film and the like by forming a metal thin film such as NiCr, Al, Ag, Pb, Zn, Ni, Au, Cr, Mo, Ir, Nb, Ta, V, Ti, Pt and the like on the film surface by means of vacuum vapor deposition, electron beam deposition, sputtering or the like, or by means of laminating the film surface with the above-mentioned metal.

The shape of the substrate may be optionally selected. For example, where the image holding member is used for electrophotography, an endless belt type or a drum type is preferable for a continuous and high speed copying. Thickness of the substrate is appropriately determined so as to form a desired photoconductive member. Where flexibility of the photoconductive member is required, the thickness may be made thin as far as the function of the substrate can be exhibited. However, from the viewpoint of manufacturing, handling and mechanical strength, the thickness is usually 10 microns or more.

The a-Si:C:H film containing silicon atom, carbon atom, and hydrogen atom constituting the most surface layer of the image holding member may be formed by carrying out discharge in a gaseous atmosphere containing one or more of so-called organhydrogenosilane compounds represented by the following general formula (1).

General formula (1)

$$R_m—Si_nH_{2n+2-m}$$

wherein: R denotes alkyl or aryl group which may be substituted, for example, a straight chain or a branched chain alkyl group having 1 to 15 carbon atoms such as methyl, ethyl, propyl, butyl, octyl, nonyl, heptadecyl and the like, substituted alkyl group such as 2-chloroethyl, 1-chloroethyl, chloromethyl, dichloromethyl and the like, aryl group such as phenyl, naphthyl and the like, or substituted aryl group such as chlorophenyl, dichlorohenyl, trichlorophenyl and the like. m is an integer of 1–15 and n is an integer of 1–7, provided that m and n satisfy the relation $2n+2>m$.

As organohydrogenosilanes used for forming a-Si:C:H film for the image holding member according to the present invention, there may be mainly mentioned, for example, $CH_3SiH_3$, $(CH_3)_2SiH_2$, $(CH_3)_3SiH$, $CH_3Si_2H_5$, $(CH_3)_2Si_2H_4$, $(CH_3)_3Si_2H_3$, $(CH_3)_4Si_2H_2$, $(CH_3)_5Si_2H$, $C_2H_5SiH_3$, $(C_2H_5)_2SiH_2$, $(C_2H_5)_3Si_2H$, $C_2H_5Si_2H_5$, $(C_2H_5)_2Si_2H_4$, $(C_2H_5)_3Si_2H_3$, $(C_2H_5)_4Si_2H_2$, $(C_2H_5)_5Si_2H$, $CH_3Si_3H_7$, $(CH_3)_2Si_3H_6$, $(CH_3)_3Si_3H_5$, $(CH_3)_4Si_3H_4$, $(CH_3)_3Si_3H_5$, and the like.

The above-mentioned organohydrogenosilanes used for producing the image holding member of the present invention have a big feature that there are hydrogen atom directly bonded to silicon atom as well as Si—C bond in the molecule.

When each constitution atom forms a new bonding in the film-like deposition layer, it is sure that a desirable three dimension structure is produced. The reason why such phenomenon occurs is not yet clear, but it could be guessed that this Si—H bond is so weak that there can be provided a relativelly active bonding site, or there may be other reasons. The above-mentioned fact seems to be related with the excellent characteristics of a-Si:C:H film of the present invention as compared with other films formed by using other starting materials.

In case that a deposition layer of a-Si:C:H film is formed according to the above-mentioned method, it is not always necessary to use the above-mentioned organohydrogenosilane alone. It is possible to incorporate a desired concentration of carbon atom in the deposition on the deposition layer by mixing at least one organohydrogenosilane with other starting material gases and controlling the mixing ratio and other production conditions.

As other starting gases which may be used together with the above-mentioned materials, when the deposition layer is formed with only silicon atom, carbon atom and hydrogen atom, as starting gases for additional supply with silicon atom, there may be used, preferably, silicon hydrides (silanes) such as $SiH_4$, $Si_2H_6$, $Si_3H_8$, $Si_4H_{10}$ and the like. When halogen atom is to coexist, there may be used preferably silicon compounds containing halogen atom, for example, silicon halides such as $SiF_4$, $Si_2F_6$, $SiCl_4$, $SiBr_4$ and the like.

Appropriate carbon atom concentration in the a-Si:C:H film according to the present invention is generally $1\times10^{-3}$–90 atomic % based on the total number of atoms constituting the film, preferably, about 1–90 atomic %. Appropriate thickness of a-Si:C:H film according to the present invention is generally 50 Å–10μ, and preferably, 500 Å–5μ.

As a deposition method for forming an a-Si:C:H film on a substrate by discharging in a gaseous atmosphere of the starting materials, there are, for example, so-called vacuum deposition methods using discharge phenomenon such as glow discharge, sputtering, ion plating and the like.

In such vacuum deposition methods, if desired, so-called rare gases such as He, Ne, Ar and the like may be used in addition to the starting gases for the purpose of diluting the gases.

In the following, there is illustrated the fabrication of an a-Si:C:H film by glow discharge.

A manufacturing apparatus using a glow discharge decomposition method is shown in FIG. 1.

In gas bombs 102 and 103, there are hermetically contained starting gases for the formation of a deposition layer of a-Si:C:H film. For example, 102 is a $(CH_3)_2SiH_2$ gas bomb (purity: 99.99%) and 103 is an $SiH_4$ gas bomb (purity: 99.99%). If necessary, bombs of other desired gases may be installed though there are not shown.

For allowing these gases to flow into reaction chamber 101, after confirmation of valves 104 and 105 of gas bombs 102 and 103, respectively, and leak valve 106 to be closed, and inflow valves 107 and 108, outflow valves 109 and 110 and auxiliary valve 111 to be opened, main valve 112 is first opened to evacuate reaction chamber 101 and the gas pipelines. Then, when the reading on vacuum indicator 113 becomes $5\times10^{-6}$ Torr, auxiliary valve 111 and outflow valves 109 and 110 are closed. Then, $(CH_3)_2SiH_2$ gas from gas bomb 102, and $SiH_4$ gas from gas bomb 103 are permitted to flow into mass-flow controllers 116 and 117 by opening valves 104 and 105 to control the pressure at outlet pressure gauges 114 and 115 to 1 kg/cm$^2$ and opening gradually inflow valves 107 and 108. Subsequently, outflow valves 109 and 110 and auxiliary valve 111 are gradually opened to permit respective gases to flow into the reaction chamber 101. Outflow valves 109 and 110 are controlled so that the flow amount ratio of respective gases may have a desired value, and opening of main valve 112 is also controlled while watching the reading on vacuum indicator 113 so that the pressure in the reaction chamber may reach a desired value. Power source 118 is set at a desired power to excite a glow discharge in reaction chamber 101. During formation of the layer, substrate cylinder 119 may be rotated at a constant speed by means of motor 120 in order to effect a uniform layer formation.

The present invention will be further explained referring to the following examples.

EXAMPLE 1

Comparison Example 1

Two aluminum cylinders of the same shape were prepared, and each of the aluminum cylinders was coated with a mixture of lactic casein 8 parts, aqueous ammonia 1 part, hydroxypropyl methyl cellulose resin (Metorose 60SH50, tradename, supplied by Shinetsu Kagaku) 2.5 parts, and water 90 parts by a soaking method followed by drying at 80° C. for 10 min. to produce an underlying layer of 10 microns thick.

Further, the resulting underlying layer on each of the two aluminum cylinders was coated with a mixure of disazo pigment of the following formula (1) 5.5 parts, polyvinylbutyral resin (Slex BXL, tradename, supplied by Sekisui Kagaku) 4.5 parts, cyclohexane 35 parts and methyl ethyl ketone 55 parts by soaking followed by drying at 100° C. for 5 min. to form a charge generation layer of 0.1 micron thick.

Formula (1):

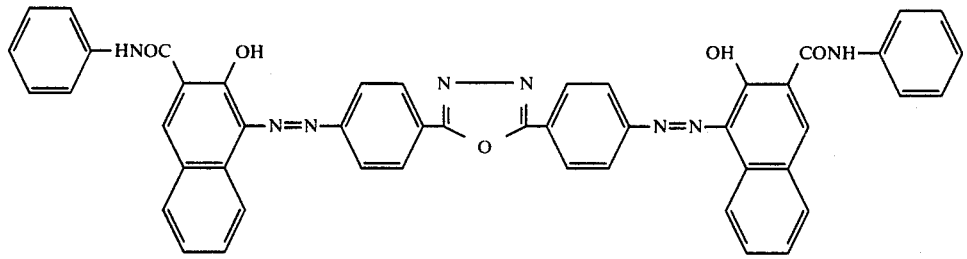

(Disazo pigment)

Then, to the surface of the resulting charge generation layer was applied a mixture of a hydrazone compound of the following formula (2) 10 parts, AB resin (Sanlex-C, tradename, supplied by Mitsubishi Monsanto Chemical Co.) 10 parts and monochlorobenzene 70 parts by soaking followed by drying at 100° C. for one hour with hot air to produce a charge transport layer of 12 microns thick.

Formula (2):

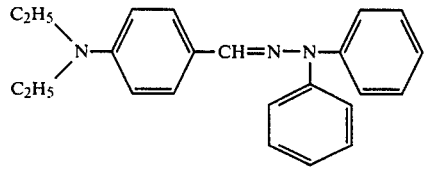

(Hydrazone)

Thus, there were produced two OPC layer drums.

One of the drums was set in a vacuum reactor in FIG. 1, and the above-mentioned glow discharge decomposition method was carried out under the conditions as shown in Table 1 below to deposit an a-Si:C:H film as a surface layer. Thus, an image holding member (Sample 1) according to the present invention was produced.

TABLE 1

| Gases and the flow rates (SCCM) | Discharge power (W/cm) | Layer forming speed (Å/sec) | Film thickness (μm) | Gas pressure (Torr) | Cylinder temp. (°C.) | Discharge frequency (MHz) |
|---|---|---|---|---|---|---|
| $(CH_3)_4Si_2H_2$:100 Ar:200 | 0.2 | 8 | 0.1 | 0.22 | 60 | 13.56 |

The other drum on which the above-mentioned a-Si:C:H film was not formed as a surface layer was used as a Comparison Sample 1.

Sample 1 of the present invention and Comparison Sample 1 were set in the same type of copying machine and images were formed under the same copying conditions for evaluation. Both samples gave good results, that is, sufficiently high quality with respect to resolution image quality and the like.

After comparing the initially produced images as mentioned above, image formation was subsequently carried out without changing the copying conditions to compare the duration ability of the drums.

Images of every 1000 sheets of copy were sampled and compared. In the case of the drum for comparison which did not have the surface layer and the OPC layer was exposed, fine scratch-like defects began to appear in the images at about 6000th sheet of copy and the defects became remarkable at about 10000th sheet of copy.

On the contrary, in the case of the drum with the surface layer according to the present invention, only a slight scratch-like defect in the images began to appear at about 50,000th sheet of copy, but the defect increased only gradually and even at 100,000th sheet of copy the defect was much lighter than that of the comparison drum without the surface layer, and the 100,000th sheet of copy can be still evaluated as a practically good image quality.

EXAMPLES 2-8

Repeating the procedure of Example 1 as shown in Table 1 for producing a-Si:C:H film except that the gases and flow rates in Table 2 below were used, there were produced images holding members.

The resulting image holding members were tested and evaluated as to durability following the methods as used in Example 1 by image formation. Each of them was durable up to about 100,000th sheet of copy and was almost comparable to that in Example 1.

TABLE 2

| Example No. | Starting gas | Starting gas flow rate (SCCM)/ Diluted gas and its flow rate (SCCM) |
|---|---|---|
| 2 | $CH_3SiH_3$ | 50/Ar 600; 100/Ar 500; 300/Ar 300; 100/$H_2$ 500; 300/$H_2$ 100; 300/$H_2$ 200; 300/$H_2$ 300 |
| 3 | $(CH_3)_2SiH_2$ | 50/Ar 600; 100/Ar 500; 300/Ar 300; 100/$H_2$ 500; 300/$H_2$ 100; 300/$H_2$ 200; 300/$H_2$ 300 |
| 4 | $(CH_3)_3SiH$ | 50/Ar 600; 100/Ar 500; 300/Ar 300; 100/$H_2$ 500; 300/$H_2$ 100; 300/$H_2$ 200; 300/$H_2$ 300 |
| 5 | $CH_3Si_2H_5$ | 50/Ar 600; 100/Ar 500; 300/Ar 300; 100/$H_2$ 500; 300/$H_2$ 100; 300/$H_2$ 200; 300/$H_2$ 300 |
| 6 | $(CH_3)_2Si_2H_4$ | 50/Ar 600; 100/Ar 500; 300/Ar 300; 100/$H_2$ 500; 300/$H_2$ 100; 300/$H_2$ 200; 300/$H_2$ 300 |
| 7 | $(CH_3)_4Si_2H_2$ | 50/Ar 600; 100/Ar 500; 300/Ar 300; 100/$H_2$ 500; 300/$H_2$ 100; 300/$H_2$ 200; 300/$H_2$ 300 |
| 8 | $C_2H_5Si_2H_5$ | 50/Ar 600; 100/Ar 500; 300/Ar 300; 100/$H_2$ 500; 300/$H_2$ 100; 300/$H_2$ 200; 300/$H_2$ 300 |

What is claimed is:

1. An image holding member which comprises a photosensitive layer of a laminate structure comprising a charge generation layer and a charge transport layer wherein at least one of the charge generation layer or the charge transport layer contains an organic material and an amorphous film containing at least silicon atom, hydrogen atom and carbon atom as main components overlying the photosensitive layer, wherein the amorphous film is formed by discharge in a gaseous atmosphere of organohydrogenosilane and wherein the organohydrogenosilane is a compound of the following general formula (1), $$R_m—Si_nH_{2n+2-m} \quad (1)$$

where R is alkyl or aryl which may be substituted, m is an integer of 1-15 and n is an integer of 1-7 provided that m and n satisfy the relation $2n+2>m$.

2. The image holding member according to claim 1, wherein the organohydrogenosilane is at least one member selected from the group consisting of $CH_3SiH_3$, $(CH_3)_2SiH_2$, $(CH_3)_3SiH$, $CH_3Si_2H_5$, $(CH_3)_2Si_2H_4$, $(CH_3)_3Si_2H_3$, $(CH_3)_4Si_2H_2$, $(CH_3)_5Si_2H$, $C_2H_5SiH_3$, $(C_2H_5)_2SiH_2$, $(C_2H_5)_3Si_2H$, $C_2H_5Si_2H_5$, $(C_2H_5)_2Si_2H_4$, $(C_2H_5)_3Si_2H_3$, $(C_2H_5)_4Si_2H_2$, $(C_2H_5)_5Si_2H$, $CH_3Si_3H_7$, $(CH_3)_2Si_3H_6$, $(CH_3)_3Si_3H_5$, $(CH_3)_4Si_3H_4$ and $(CH_3)_3Si_3H_5$.

3. The image holding member according to claim 1, wherein thickness of the amorphous film is 500 Å-5μ.

4. The image holding member according to claim 3, wherein thickness of the amorphous film is 500 Å-5μ.

5. The image holding member according to claim 1, wherein the amorphous film contains $1\times10^{-3}$-90 atomic % of carbon based on total number of atoms.

6. The image holding member according to claim 5, wherein the amorphous film contains 1-90 atomic % of carbon atom based on total number of atoms.

7. The image holding member according to claim 1, wherein the charge transport layer overlies the charge generation layer.

8. The image holding member according to claim 1 wherein the charge transport layer contains a charge transport material and a binder.

9. The image holding member according to claim 8, wherein the charge transport material is a hole transport material or an electron transport material.

10. The image holding member according to claim 9 wherein the hold transport material is at least one member selected from the group consisting of polycyclic aromatic compounds, carbazole compounds, oxadiazole compounds, pyrazoline compounds, hydrazone compounds and organic photoconductive polymers.

11. The image holding member according to claim 9 wherein the electron transport material is at least one member selected from the group consisting of anil compounds, cyano type compounds, nitrofluorenone type compounds and nitroxanthone type compounds.

12. The image holding member according to claim 1 wherein the charge generation layer contains a charge generation material and a binder.

13. The image holding member according to claim 12 wherein the charge generation material is at least one member selected from the group consisting of azo pigment, quinone pigment, quinocyanine pigment, perylene pigment, indigo pigment, bisbenzimidazole pigment, phthalocyanine pigment, quinacridone pigment, pyrylium dye or the co-crystalline complex, thiapyrylium dye or the co-crystalline complex, squaric acid methine dye, amorphous silicon, selenium, selenium-tellurium and cadmium sulfide.

14. The image holding member according to claim 1 wherein the charge generation layer contains azo pigment and a binder.

15. The image holding member according to claim 14 wherein the above azo pigment is disazo pigment.

16. The image holding member according to claim 1 wherein the charge generation layer is an amorphous silicon film.

17. The image holding member according to claim 1 wherein the charge generation layer is a selenium film or a tellurium film.

18. The image holding member according to claim 1 wherein the image holding member is an electrophotographic image holding member.

19. An image holding member which comprises a photosensitive layer comprising a photoconductive material and an organic charge transport binder and an amorphous film containing at least silicon atom, hydrogen atom and carbon atom as main components overlying the photosensitive layer, wherein the amorphous film is formed by discharge in a gaseous atmosphere of organohydrogenosilane and wherein the organohydrogenosilane is a compound of the following general formula (1)

$$R_m—Si_nH_{2n+2-m}$$

where R is alkyl and aryl which may be substituted, m is an integer of 1–15 and n is an integer of 1–7, provided that m and n satisfy the relation $2n+2>m$.

20. The image holding member according to claim 19 wherein thickness of the amorphous film is 50 Å–10μ.

21. The image holding member according to claim 20 wherein thickness of the amorphous film is 500 Å–5μ.

22. The image holding member according to claim 19 wherein the amorphous film contains $1\times10^{-3}$–90 atomic % of carbon atom based on total number of atoms.

23. The image holding member according to claim 19 wherein the charge transport binder is an organic photoconductive polymer.

24. An image holding member which comprises a photosensitive layer comprising a photoconductive material and an organic binder and an amorphous film containing at least silicon atom, hydrogen atom and carbon atom as main components overlying the photosensitive layer, wherein the amorphous film is formed by discharge in a gaseous atmosphere of organohydrogenosilane and wherein the organohydrogenosilane is a compound of the following general formula (1)

$$R_m—Si_nH_{2n+2-m} \quad (1)$$

where R is alkyl or aryl which may be substituted, m is an integer of 1–15 and n is an integer of 1–7, provided that m and n satisfy the relation $2n+2>m$.

25. The image holding member according to claim 24 wherein the organohydrogenosilane is at least one member selected from the group consisting of $CH_3SiH_3$, $(CH_3)_2SiH_2$, $(CH_3)_3SiH$, $CH_3Si_2H_5$, $(CH_3)_2Si_2H_4$, $(CH_3)_3Si_2H_3$, $(CH_3)_4Si_2H_2$, $(CH_3)_5Si_2H$, $C_2H_5SiH_3$, $(C_2H_5)_2SiH_2$, $(C_2H_5)_3Si_2H$, $C_2H_5Si_2H_5$, $(C_2H_5)_2Si_2H_4$, $(C_2H_5)_3Si_2H_3$, $(C_2H_5)_4Si_2H_2$, $(C_2H_5)_5Si_2H$, $CH_3Si_3H_7$, $(CH_3)_2Si_3H_6$, $(CH_3)_3Si_3H_5$, $(CH_3)_4Si_3H_4$ and $(CH_3)_3Si_3H_5$.

26. The image holding member according to claim 24, wherein thickness of the amorphous film is 50 Å–10μ.

27. The image holding member according to claim 26, wherein thickness of the amorphous film is 500 Å–5μ.

28. The image holding member according to claim 24 wherein the amorphous film contains $1\times10^{-3}$–90 atomic % of carbon atom based on total number of atoms.

29. The image holding member according to claim 28 wherein the amorphous film contains 1–90 atomic % of carbon atom based on total number of atoms.

30. The image holding member according to claim 24, wherein the photoconductive material is an organic photoconductive material.

* * * * *

UNITED STATES PATENT AND TRADEMARK OFFICE

CERTIFICATE OF CORRECTION

PATENT NO. : 4,687,722

DATED : August 18, 1987

INVENTOR(S) : Kyosuke Ogawa

It is certified that error appears in the above-identified patent and that said Letters Patent is hereby corrected as shown below:

COLUMN 1

Line 12, "a" (first occurrence) should read --as--.
Line 36, "which" should read --while--.

COLUMN 3

Line 12, ""a-Si-C:H film")" should read --"a-Si:C:H film")--.
Line 33, "layer composed" should read --layer is composed--.
Line 49, "methin-dye," should read --methine-dye,--.
Line 66, "generatrion" should read --generation--.

COLUMN 4

Line 2, "compound" should read --compounds--.
Line 45, "transorts" should read --transport--.

COLUMN 5

Line 7, "be for" should read --be used for--.
Line 20, "provide other layer is" should read --permit another layer to be--.
Line 24, "$In_2O_3$;" should read --$In_2O_3$,--.
Line 25, "$SnO_2$ITO" should read --$SnO_2$, ITO--.
Line 42, "viewpoint" should read --viewpoints--.
Line 49, "organhydrogenosilane" should read --organohydrogenosilane--.

UNITED STATES PATENT AND TRADEMARK OFFICE

CERTIFICATE OF CORRECTION

PATENT NO. : 4,687,722

DATED : August 18, 1987

INVENTOR(S) : Kyosuke Ogawa

It is certified that error appears in the above-identified patent and that said Letters Patent is hereby corrected as shown below:

COLUMN 6

Line 2, "$(CH_3)_3SiH,CH-$" should read --$(CH_3)_3SiH$, CH---.
Line 18, "relativelly" should read --relatively--.
Line 28, delete "on the deposition".

COLUMN 7

Line 1, "there" should be --these--.

COLUMN 9

Line 21, "images" should read --image--.

COLUMN 10

Line 9, "500 Å-5μ." should read --50 Å-10μ.--.

Signed and Sealed this

Fifteenth Day of March, 1988

*Attest:*

*Attesting Officer*

DONALD J. QUIGG

*Commissioner of Patents and Trademarks*